US006056583A

United States Patent [19]

Lee et al.

[11] Patent Number: 6,056,583

[45] Date of Patent: May 2, 2000

[54] FOLDABLE SUPPORTING BRACKET ASSEMBLY

[75] Inventors: Shun-Jung Lee, Pan-Chiao; Pei-Rong Wang, Tu-Chen; Ching-Ho Lai, Tao-Yuan Hsien, all of Taiwan

[73] Assignee: Hon Hai Precision Ind. Co., Ltd., Taipei Hsien, Taiwan

[21] Appl. No.: 09/127,072

[22] Filed: Jul. 31, 1998

[30] Foreign Application Priority Data

Aug. 30, 1997 [TW] Taiwan ..... 86214968

[51] Int. Cl.[7] ..... H01R 13/64

[52] U.S. Cl. ..... 439/377; 439/157; 439/326

[58] Field of Search ..... 439/436, 437, 439/377, 325, 326, 327, 296, 345, 314, 152, 157, 567; 361/801, 759

[56] References Cited

U.S. PATENT DOCUMENTS

| | | | |
|---|---|---|---|
| 3,829,741 | 8/1974 | Athey | 361/756 |
| 3,932,016 | 1/1976 | Ammenheuser | 439/377 |
| 5,145,395 | 9/1992 | Kuei Lai | 439/326 |
| 5,207,598 | 5/1993 | Yamada et al. | 439/636 |
| 5,286,217 | 2/1994 | Liu et al. | 439/326 |
| 5,372,518 | 12/1994 | Liu et al. | 439/326 |
| 5,395,262 | 3/1995 | Lwee | 439/326 |
| 5,542,854 | 8/1996 | Bowen | 439/157 |
| 5,569,043 | 10/1996 | Liu | 439/326 |
| 5,599,207 | 2/1997 | Lai | 439/567 |
| 5,846,095 | 12/1998 | Bowen | 439/157 |
| 5,889,656 | 3/1999 | Yin | 361/801 |

*Primary Examiner*—Paula Bradley
*Assistant Examiner*—Alexander Gilman

[57] ABSTRACT

A foldable supporting bracket assembly for use with a connector comprises a supporting bracket having a mounting joint at each end thereof, and a supporting pillar pivotably assembled to the mounting joint. Interengaging means for securely positioning the supporting pillar with respect to the mounting joint includes a raised portion integrally formed at a base wall of the pillar. The raised portion defines a directing passage therethrough. A block portion is integrally formed between lugs of the mounting joint and defines a retaining passage therethrough. A latch tab is inserted through the directing passage and the retaining passage thereby securely positioning the supporting pillar with respect to the mounting joint.

9 Claims, 6 Drawing Sheets

FOLDABLE SUPPORTING BRACKET ASSEMBLY

FIELD OF THE INVENTION

The present invention relates to a supporting bracket assembly, and more particularly to a foldable supporting bracket assembly for receiving a slot-shaped receptacle connector adapted for mounting onto a substrate.

DESCRIPTION OF PRIOR ART

Conventionally, a central processing unit is mounted onto a motherboard by means of a socket. However, as central processing units becomes more powerful, the traditional mounting method is no longer acceptable for CPU's of larger dimension. For example, the Pentium series CPU is firstly mounted onto a daughter board having golden fingers, then the daughter board is inserted onto a slot-shaped receptacle connector.

The daughter board has a predetermined height and only the golden fingers are engaged with the slot-shaped receptacle, thus the support provided thereto is insufficient. As the daughter board is merely retained and supported by the squeezing force of the receptacle, the daughter board tends to pitch back and forth when acted on by an external horizontal force applied thereof, especially when a heat sink together with a cooling fan is mounted thereto. The pitching movement may adversely affect the electrical connection between the golden fingers and the contacts within the receptacle which will jeopardize the system operation.

In order to eliminate the pitching movement of the daughter board several different arrangements have been introduced all of which provide integrally formed retaining means at each side of the slot-shaped receptacle connector. Taiwan Utility Model Application Nos. 85216861, 85216815, 85215723, 85216150, and U.S. Pat. Nos. 3,993,390, 4,057,879, 5,207,598, 5,259,793 and 5,429,523 disclose such arrangement.

Alternatively, the retaining device is made independently and then assembled to the slot-shaped receptacle connector as disclosed in U.S. Pat. Nos. 2,825,037 and 3,829,741.

Each retaining device disclosed above extends vertically from each side of the receptacle connector and greatly increases the dimension of the slot-shaped receptacle connector resulting in increased packaging costs.

SUMMARY OF THE INVENTION

An objective of the present invention is to provide a supporting bracket assembly having supporting pillars pivotably mounted thereto for reducing the height of the bracket thereby reducing the packaging cost thereof.

Another objective of the present invention is to provide a supporting bracket assembly having supporting pillars pivotably mounted thereto whereby the engagement between the supporting bracket and the supporting pillars can be conveniently achieved.

In order to achieve the objectives set forth, a foldable supporting bracket assembly for use with a connector comprises a supporting bracket having a mounting joint at each end, and a supporting pillar pivotably assembled to the mounting joint. Interengaging means for securely positioning the supporting pillar with respect to the mounting joint includes a raised portion integrally formed at a base wall of the pillar. The raised portion defines a directing passage therethrough. A block portion is integrally formed between lugs of the mounting joint and defines a retaining passage therethrough. A latch tab is inserted through the directing passage and the retaining passage thereby securely positioning the supporting pillar with respect to the mounting joint.

These and additional objects, features, and advantages of the present invention will become apparent after reading the following detailed description of the preferred embodiment of the invention taken in conjunction with the appended drawings.

BRIEF DESCRIPTION OF DRAWINGS

FIG. 1 is a perspective exploded view of a supporting bracket assembly in accordance with the;

DETAILED DESCRIPTION OF THE PREFERRED EMBODIMENT

Figure 1:
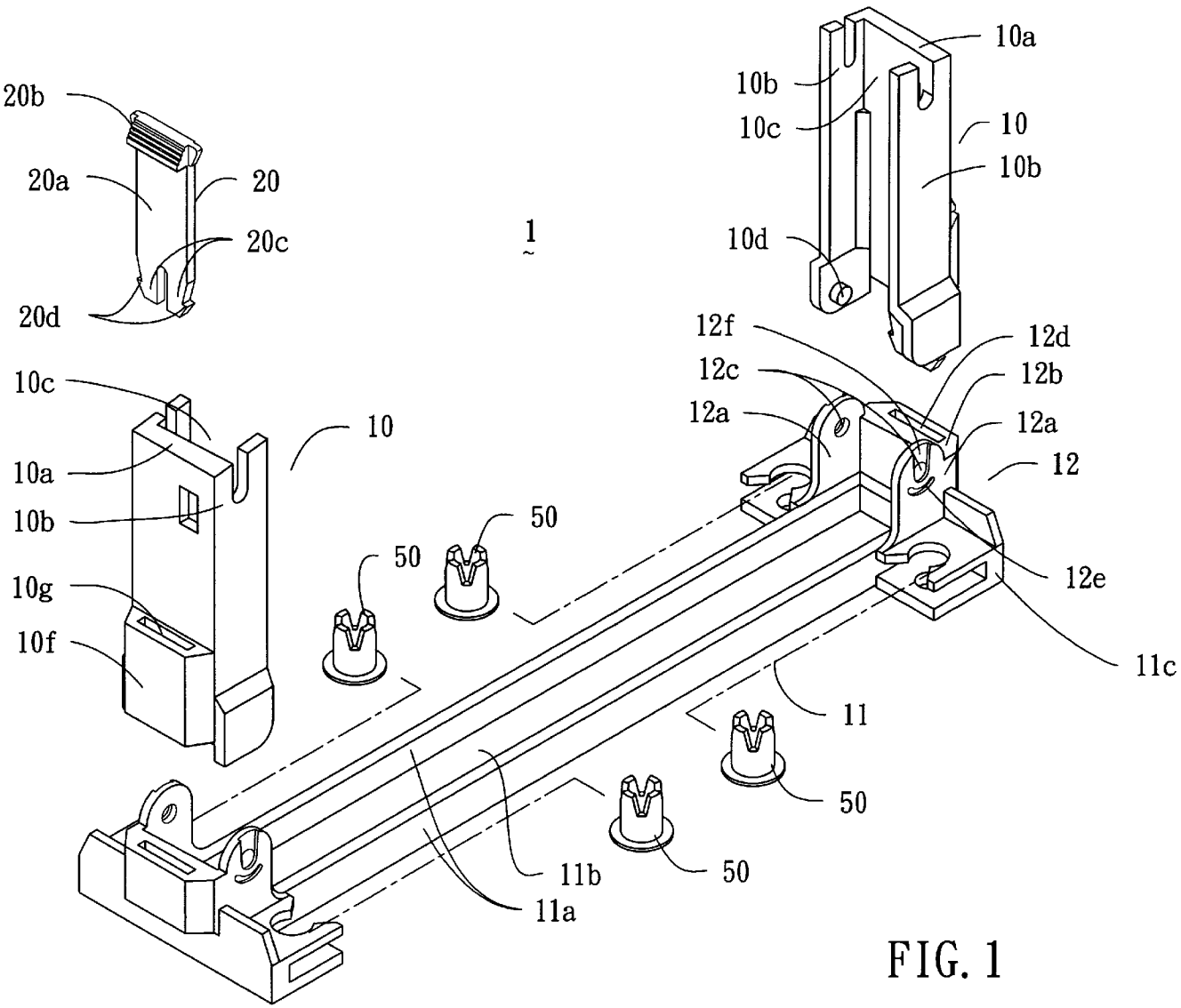
Figure 2C:
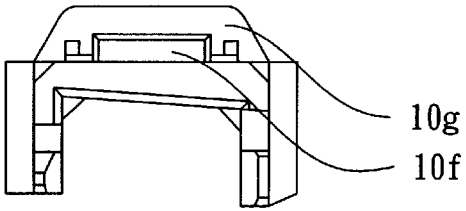
FIGS. 2A, 2B and 2C are front, left elevational, and top plan views of the supporting pillar in accordance to a present invention, respectively.
Figure 2A:
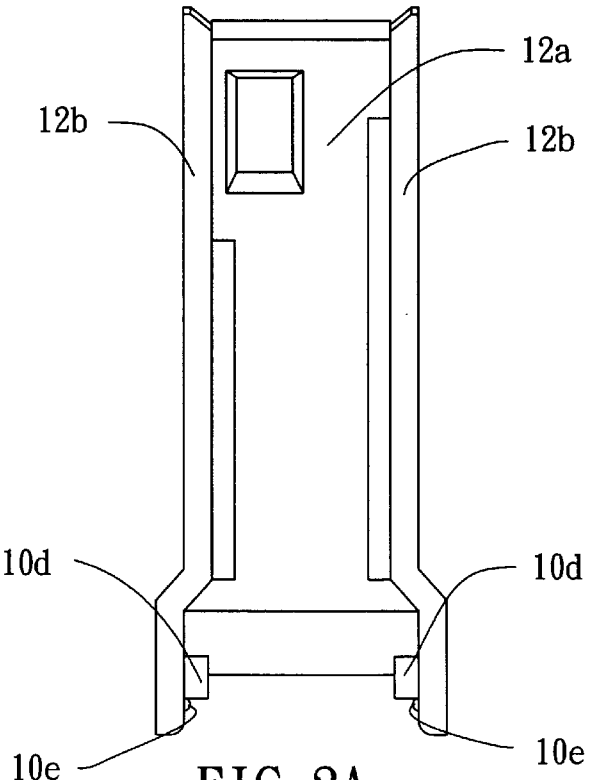
Figure 2B:
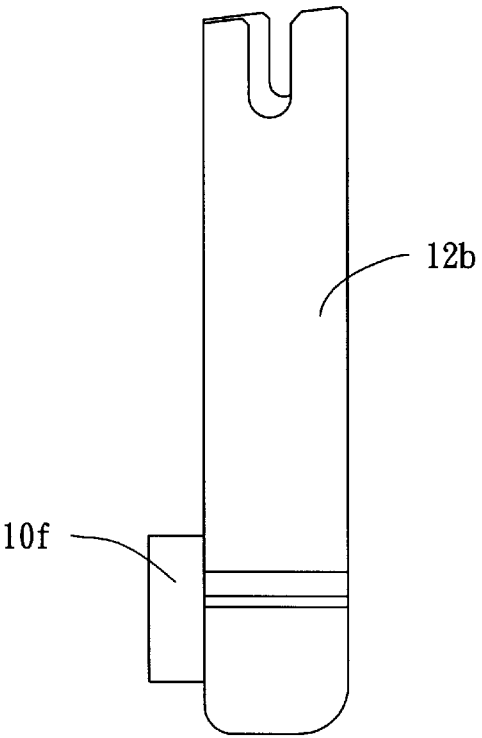

Referring to FIGS. 1, 2A, 2B and 2C, a foldable supporting bracket assembly 1 in accordance with the present invention generally comprises a supporting bracket 11 having a mounting joint 12 at each end thereof, and a supporting pillar 10 pivotably assembled to the mounting joint 12. The supporting bracket 11 includes a pair of elongate plates 11*a* forming a receiving slot 11*b* therebetween in which a receptacle connector (not shown) is received. The supporting bracket 11 forms a mounting foot 11*c* at each side portion thereof for anchoring onto a substrate (not shown) by means of a locking bolt (not shown) and nut arrangement 50 seated in each mounting foot 11*c*.

Figure 3B:
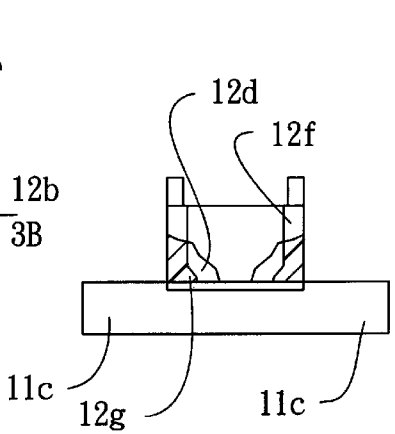
FIG. 3B is a cross sectional view taken along line 3B—3B of FIG. 3A.

The mounting joint 12 is integrally formed with the supporting bracket 11 and includes a pair of pivoting lugs 12*a* extending vertically from the elongate plates 11*a*. Each pivoting lug 12 defines a pivot hole 12*c* therethrough and a guiding groove 12*e* thereon. A block portion 12*b* is integrally formed between the pivoting lugs 12*a* and defines an engaging passage 12*d* therethrough. The engaging passage 12*d* forms barbs 12*g* (FIG. 3B) on an inner wall (not labeled) thereof.

The supporting pillar 10 has a U-shaped configuration forming a base wall 10*a* and a pair of end walls 10*b* extending vertically from the base wall 10*a*. The end walls 10*b* define a retaining trench 10*c* therebetween for firmly supporting an edge of a substrate (not shown) therein. A lower inner portion (not labeled) of each end wall 10*b* forms a projection 10*d* and a guiding bud 10*e* movably assembled to the pivot hole 12*c* and guiding groove 12*e*, respectively. The lug 12*a* further forms a guiding recess 12*f* for directing the projection 10*d* into the pivot hole 12*c*. By this arrangement, when the supporting pillar 10 is pivotably assembled to the mounting joint 12, the pivotal movement of the supporting pillar 10 will be limited by the arrangement between the guiding groove 12*e* and the guiding bud 10*e*. The supporting pillar 10 further forms a raised block portion 10*f* defining a directing passage 10*g* aligned with the engaging passage 12*d* of the block portion 12*b*.

A latching tab 20 defines a body 20*a*, a head portion 20*b*, and a pair of legs 20*c* spaced from each other. Each leg 20*c* further forms a spike 20*d* adapted for being engaged with the barb 12*g* of the directing passage 10*g* when the latch tab 20 passes through the engaging passage 12*d*.

Figure 3A:
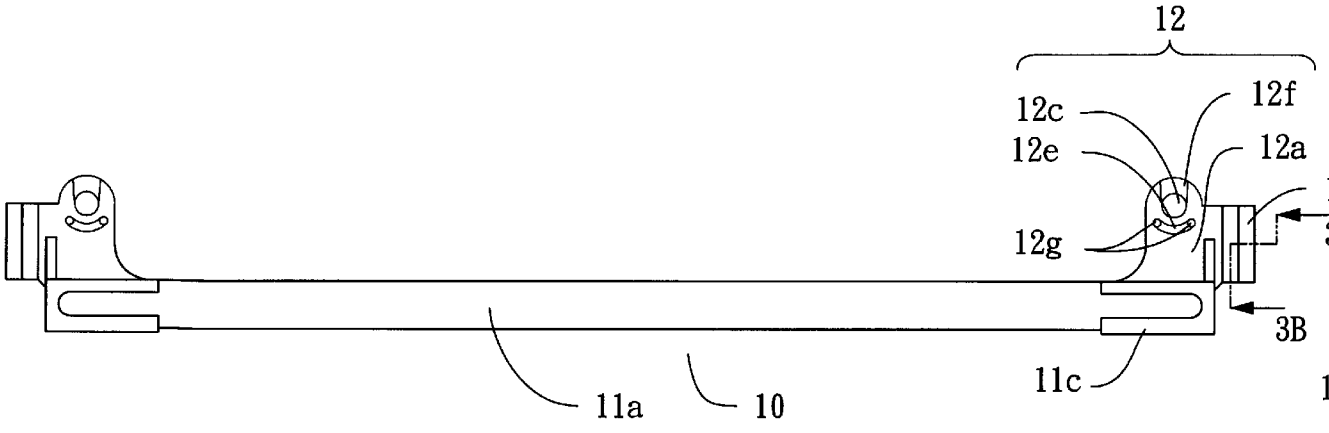
FIG. 3A is a front view of the supporting bracket.

Referring to FIG. 3A, the guiding groove 12*e* forms a positioning recess 12*g* whereby which the supporting pillar 10 can be selectively positioned between a vertical position and a horizontal position.

Figure 4A:
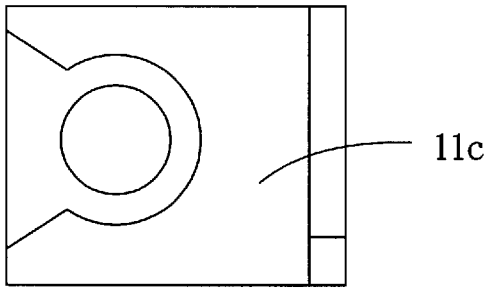
FIGS. 4A and 4B are top plan and front views of the mounting foot of the supporting bracket, respectively.
Figure 4B:
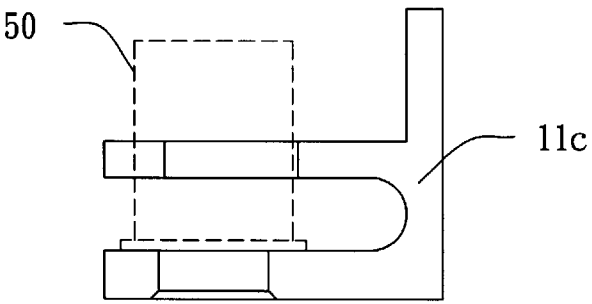

FIGS. 4A and 4B show the top plan view and side elevational view of the mounting foot 11*c* of the supporting bracket 11. The nut arrangement 50 can be movably disposed within the mounting foot 11*c* for further engagement with a locking bolt (not shown).

Figure 6:
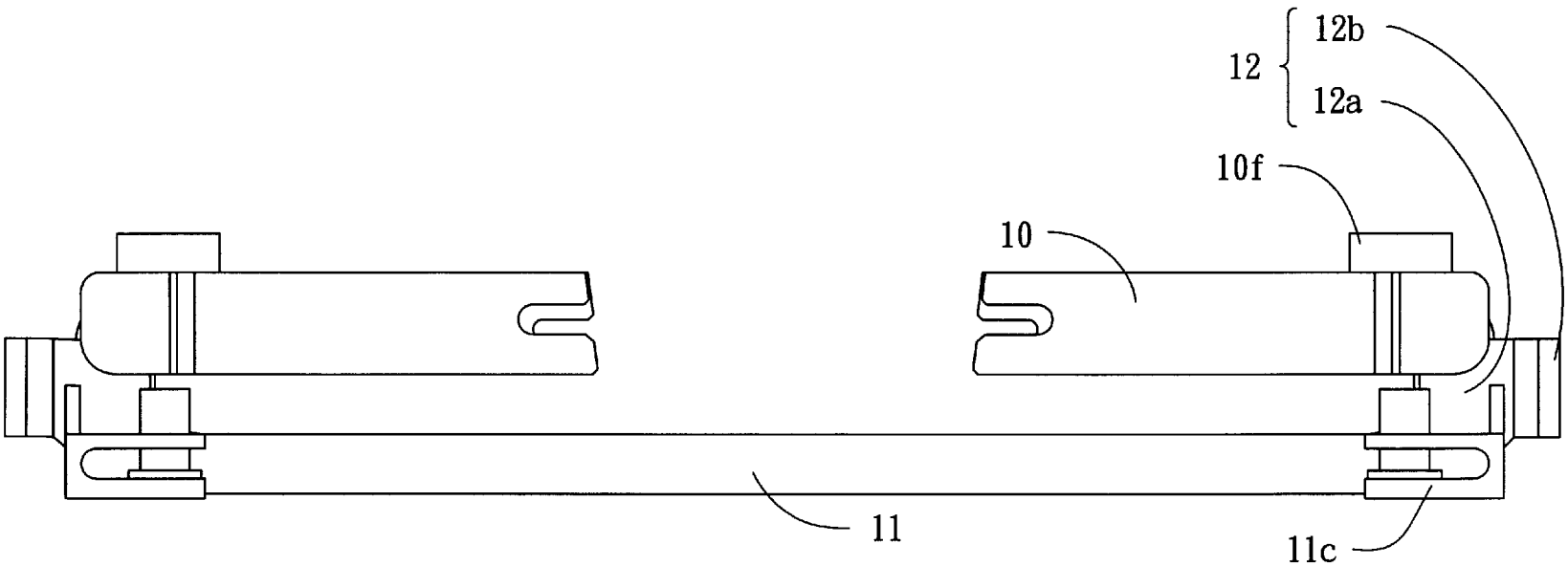
FIG. 6 is a front view of a supporting bracket assembly with folded supporting pillars.

Referring to FIG. 6, the supporting pillar 10 can be pivotably assembled to the mounting joint 12 by engagement between the projection 10*d* and the pivot hole 12*c*. Meanwhile, the guiding bud 10*e* is also movably located within the guiding groove 12*e*. Accordingly, the supporting pillar 10 may pivotably move with respect to the supporting bracket 11. In this case, the engagement between the guiding bud 10*e* and the positioning recess 12*g* can only position the supporting pillar 10 in vertical or horizontal positions. In FIG. 6, the supporting pillar 10 is positioned at a horizontal position.

Figure 5:
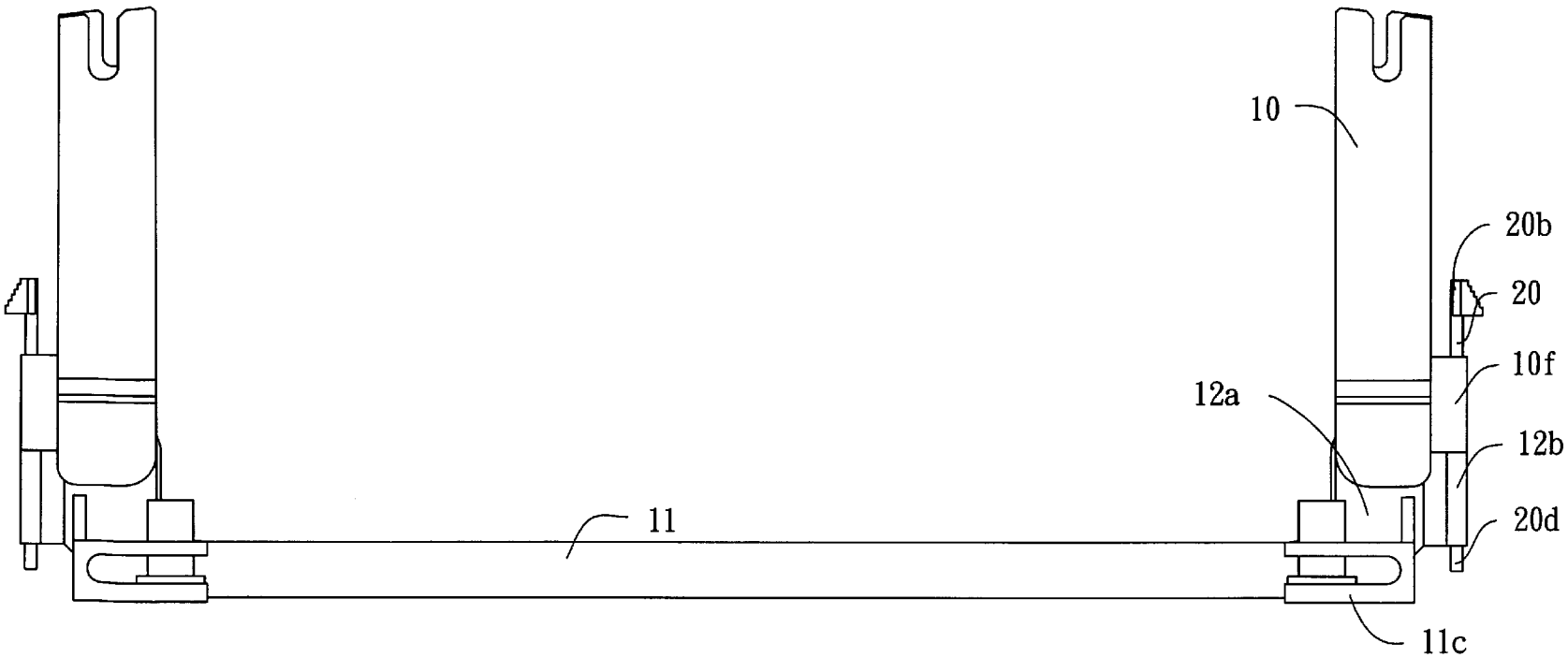
FIG. 5 is a front view of an assembled supporting bracket assembly with extended supporting pillars.

If the supporting pillars 10 are used to support a daughter board (not shown) therebetween, each supporting pillar 10 is secured at the vertical position. Referring to FIG. 5, after the supporting pillar 10 is erected due to the engagement between the guiding bud 10*e* and the guiding groove 12*e*, the latch tab 20 then is inserted through the directing passage 10*g* and the retaining passage 12*d*. As a result, the supporting pillar 10 is securely positioned with respect to the supporting bracket 11. The daughter board can then be firmly supported between the supporting pillars 10 and the pitching movement thereof is effectively eliminated.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims. Therefore, persons of ordinary skill in this field are to understand that all such equivalent structures are to be included within the scope of the following claims.

What is claimed is:

1. A foldable supporting bracket assembly for use with a receptacle connector, comprising:

a supporting bracket including a pair of elongate plates forming a receiving slot therebetween for receiving the receptacle connector therein;

a mounting joint integrally formed on each end of said supporting bracket and including a pair of pivoting lugs extending vertically from said elongate plate, each pivoting lug defining a pivot hole therethrough;

a supporting pillar having a U-shaped configuration forming a base wall and a pair of end walls extending vertically from said base wall, said end walls defining a retaining trench therebetween for firmly supporting an edge of a substrate therein, each said end wall forming a projection for pivotably engaging with said pivot hole; and interengaging means for securely positioning said supporting pillar with respect to said mounting joint and including a raised portion integrally formed at said base wall, said raised portion defining a directing passage therethrough and a block portion integrally formed between said lugs and defining a retaining passage therethrough, and a latch tab inserted through said directing passage and said retaining passage thereby securely positioning said supporting pillar with respect to said mounting joint.

2. A foldable supporting bracket assembly as recited in claim 1, wherein a barb is formed at bottom of said retaining passage.

3. A foldable supporting bracket assembly as recited in claim 1, wherein said latch tab further includes a spike engaged with said barb of said retaining passage.

4. A foldable supporting bracket assembly as recited in claim 1, wherein a guiding groove is formed adjacent to said pivot hole of said lug.

5. A foldable supporting bracket assembly as recited in claim 4, wherein said guiding groove further includes a positioning recess at each end thereof.

6. A foldable supporting bracket assembly as recited in claim 5, wherein each end wall further includes a guiding bud movably received in said guiding groove and selectively positioned within said positioning recess.

7. A foldable supporting bracket assembly as recited in claim 1, wherein said supporting bracket further includes mounting feet adjacent to end portions thereof, a nut arrangement being disposed within each mounting foot.

8. A foldable supporting bracket assembly including:

a supporting bracket forming a receiving slot for receiving an electrical device therein;

a mounting joint disposed at either end of the supporting bracket and including a pair of pivoting lugs extending vertically at said ends of the supporting bracket;

a supporting pillar disposed on each mounting joint and including a base wall and a pair of end walls extending perpendicularly from the base wall for firmly supporting an edge of a substrate;

means for pivoting each supporting pillar with regard to the corresponding mounting joint;

a guiding groove formed in each of said pivoting lugs and including a positioning recess at each end of the groove; and a guiding bud formed at each end wall movably received in said guiding groove and selectively positioned within said positioning recess;

a second means for securely positioning said supporting pillar with regard to the corresponding mounting joint when said pillar in a vertical position, said second means including a raised portion intergrally formed at said base wall with directing passage defined through the raised portion, a block portion integrally formed between said lugs of the supporting bracket with a retaining passage defined through the block portion, and a latch tab inserted through said directing passage and said retaining passage.

9. A foldable supporting bracket assembly including:

a supporting bracket forming a receiving slot for receiving an electrical device therein;

a mounting joint disposed at either ends of the supporting bracket;

a supporting pillar disposed on each mounting joint and defining a base wall with a pair of end walls aside thereof;

first means for pivoting each supporting pillar with regard to the corresponding mounting joint; and second means for securely positioning said supporting pillar with regard to the corresponding mounting joint when said supporting pillar is in a vertical position; wherein said second means includes a latch tab extending along a plane parallel to said base wall and simultaneously engaged with both passage in the supporting pillar and the mounting joint when said supporting pillar is in the vertical position so that said supporting pillar can not be pivoted with regard to the mounting joint without first removing said second means therefrom.

* * * * *